United States Patent [19]

Lin

[11] Patent Number: 4,921,460

[45] Date of Patent: May 1, 1990

[54] ASSEMBLED ARTICLES COMPRISING STRETCH KNITTED RINGS

[76] Inventor: Ping-Chia Lin, P.O. Box 10160, Taipei, Taiwan

[21] Appl. No.: 371,624

[22] Filed: Jun. 26, 1989

[51] Int. Cl.[5] ..... A63H 3/36; A63H 3/02

[52] U.S. Cl. ..... 446/385; 446/369

[58] Field of Search ..... 446/369, 370, 371, 372, 446/373, 374, 380, 385, 386, 387, 388, 389, 486, 487, 488, 321, 490, 491, 268

[56] References Cited

U.S. PATENT DOCUMENTS

| | | | |
|---|---|---|---|
| 1,966,986 | 7/1934 | Martin | 446/321 |
| 2,090,499 | 8/1937 | Gustafsson | 446/374 |
| 2,249,335 | 7/1941 | Turner | 446/385 |
| 2,516,479 | 7/1950 | Opel | 446/373 |
| 2,812,616 | 11/1957 | Ford | 446/374 |
| 3,552,057 | 1/1971 | De Laillevault | 446/374 |
| 4,107,873 | 8/1978 | Bauer | 446/372 X |
| 4,123,872 | 11/1978 | Silva | 446/374 |
| 4,816,001 | 3/1989 | Narvaes et al. | 446/374 X |

FOREIGN PATENT DOCUMENTS

| | | | |
|---|---|---|---|
| 417385 | 3/1934 | United Kingdom | 446/385 |
| 1502941 | 3/1978 | United Kingdom | 446/385 |
| 2135204 | 8/1984 | United Kingdom | 446/385 |
| 2138307 | 10/1984 | United Kingdom | 446/385 |

*Primary Examiner*—Robert A. Hafer
*Assistant Examiner*—D. Neal Muir

[57] ABSTRACT

An assembled toy, doll or decorative article is composed of a plurality of stretchable knitting rings, tori or cylinders which are optionally tied, wound, twisted, bound, bonded or assembled with one another to mimic an animal or a person vividly and lively.

6 Claims, 3 Drawing Sheets

ASSEMBLED ARTICLES COMPRISING STRETCH KNITTED RINGS

BACKGROUND OF THE INVENTION

Carl R. Heldt disclosed a structural toy in his U.S. Pat. 3,698,123 comprised of round rods bifurcated at both ends of each round rod and rings, which however may have the following drawbacks:

1. The rods and rings are rigid and can not be free wound, tied, pleated, bent or twisted to form a soft, flexible, optionally-oriented toy or ornamental device, lacking of a vividness of a toy, a doll, an animal or any other decorative articles.

2. The rods should be further processed to be bifurcated at their ends to increase their production cost.

The present inventor has found the drawbacks of a conventional structural toy and invented the present assembled article comprised of stretchable knitting members.

SUMMARY OF THE INVENTION

The object of the present invention is to provide an assembled article having three dimensional configuration, such as a toy, a doll, an animal, or any other ornamental or decorative devices, composed of a plurality of stretchable knitting rings or cylinders which are wound, tied, bound or assembled with one another to form a soft, collapsible, stretchable, flexible article to mimic a vivid animal, a person or the like.

DETAILED DESCRIPTION

Figure 1:
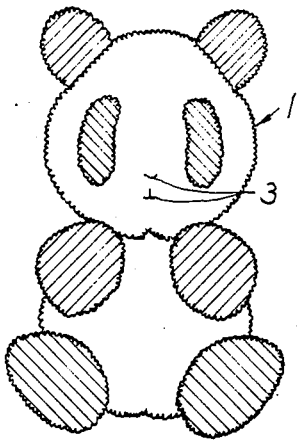
FIG. 1 is an illustration of a panda formed in accordance with the present invention.
Figure 2:
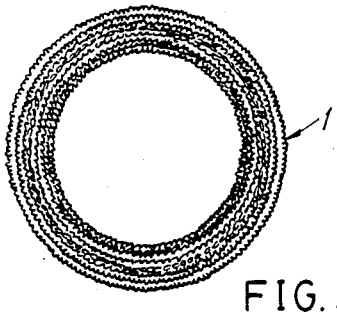
FIG. 2 shows a basic stretchable ring in construction of the present invention.
Figure 2A:
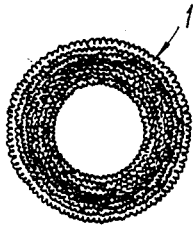
FIG. 2*a* shows a stretchable ring of smaller size of the present invention.
Figure 3A:
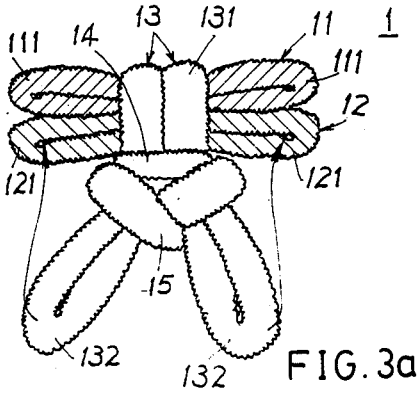
FIGS. 3*a*–3*d* show steps for forming a panda head of the present invention.
Figure 3B:
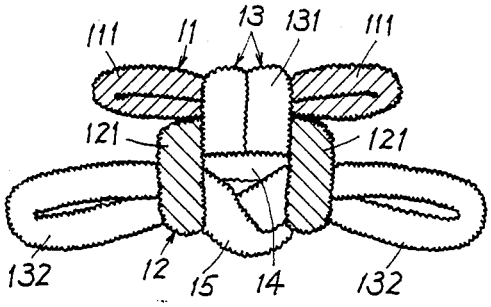
Figure 3C:
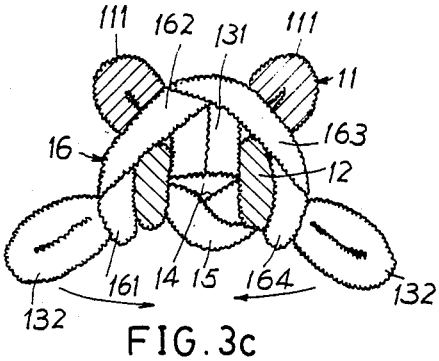
Figure 3D:
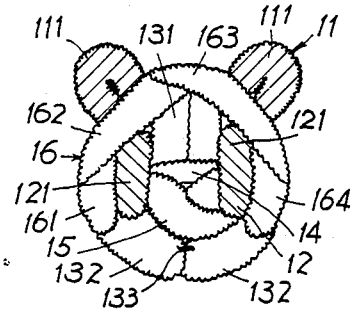

As shown in FIGS. 1–4, the present invention comprises an animal of a panda composed of a plurality of stretchable knitting rings 1 as shown in FIG. 2. Each stretchable knitting ring 1 may be made of knitting materials having terry or velvet surface reinforced by rubber yarn, forming a seamless soft stretchable ring or torus. The size, structural shapes and colors of each ring 1 of the present invention are not limited.

Figure 4A:
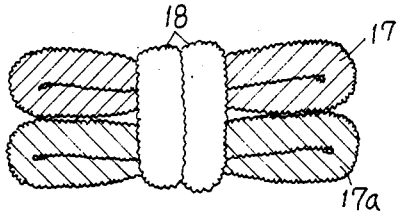
FIGS. 4*a*–4*c* show further steps for assembling a panda of the present invention.
Figure 4B:
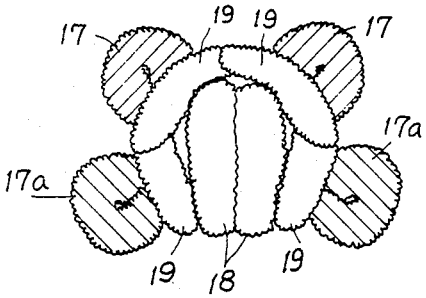
Figure 4C:
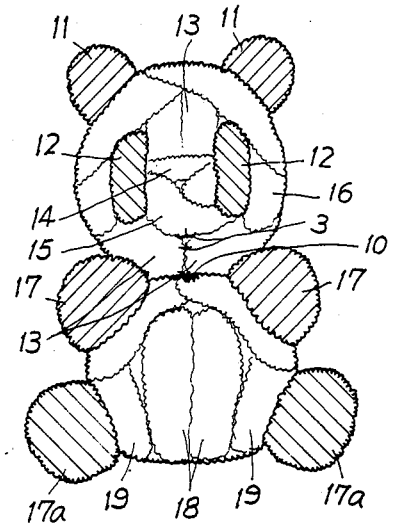

In making a panda as shown in FIG. 1, a panda head may be assembled by the steps as shown in FIG. 3 and a panda body is then assembled with the head by the further steps as shown in FIG. 4, therefore forming an integral panda.

As shown in FIG. 3, two black rings 11, 12 are horizontally inserted through two upper loops 131 of the other two vertical white rings 13. Another ring 14 may be doubly tied on an upper portion of the two vertical rings 13 to form a cheek including its nose of the panda head. Still another ring 15 is crossingly tied on two lower loops 132 of the two vertical rings 13 to form a chin including its mouth of the panda head (FIG. 3*a*). Each lower loop 132 is then inserted through each side loop 121 of the second horizontal ring 12 as shown in FIG. 3*b*. A twisting ring 16 is subsequently twisted and wound around a lower loop 132 of a left vertical ring 13, a left side loop and a right side loop 111 of the first ring 11, and a lower loop 132 of a right vertical ring 13 as shown in FIG. 3*c*. Both lower loops 132 are then stitched or bonded by adhesive at numeral 133 as shown in FIG. 3*d* to finish the panda head. The nose and mouth of the panda may be painted, printed or drawn on the head as numeral 3 as shown in FIG. 1.

The panda body can be assembled as shown in FIG. 4, in which two horizontal black rings 17, 17*a* are wound by a white central ring 18 which is tied on the two rings 17 by forming double loops as shown in FIG. 4*a*. The upper ring 17 will serve as its front feet and the lower ring 17*a* may serve as its rear feet. A lower fencing ring 19 may be twistingly wound around four side loops formed by the two rings 17, 17*a* as tied by a central ring 18 to mimic a panda body more precisely as shown in FIG. 4*b*. Naturally, the fencing ring 19 may also be two rings 19, 19, both wound around a left front foot and a left rear foot, and wound on a right front foot and right rear foot respectively. The upper head as assembled by FIG. 3 is then secured to the body as shown in FIG. 4 by stitching, adhesive bonding or other connection method at numeral 10. The ring 11 may be made of black color to imitate the panda's ears, while the ring 12 may also be black to mimic panda's eyes. Rings 17, 17*a* are also black in contrast to a white body formed by rings 18, 19.

Figure 5:
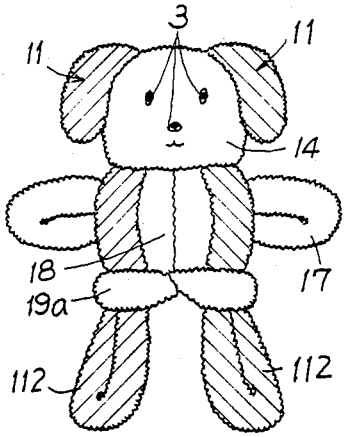
FIG. 5 shows another preferred embodiment of a dog formed in accordance with the present invention.
Figure 6:
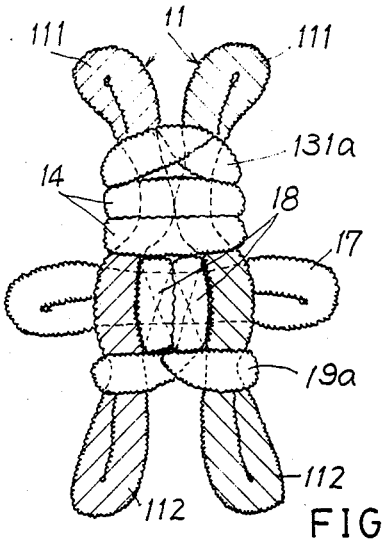
FIG. 6 shows a structural relationship of rings for making a dog as shown in FIG. 5.

As shown in FIGS. 5, 6, a dog of the present invention can be made, in which two vertical rings 11 are wound by an uppermost ring 131*a* (twisted to form double loops on two upper loops 111 of the two rings 11) to serve as a forehead of the dog, an upper ring 14 being wound around the two rings 11 under the uppermost ring 131*a* to serve as a cheek of the dog, a central vertical ring 18 being wound on a central horizontal ring 17 by forming double loops on the ring 17 to serve as a chest and an abdomen or an upper clothing, the central horizontal ring 17 being inserted through two vertical rings 11 to protrude laterally to form two front feet of the dog, and a lower ring 19*a* being twisted to tie around two lower loops 112 of the two rings 11 to serve as dog trousers worn on two rear legs as imitated by the two lower loops 112.

Figure 7:
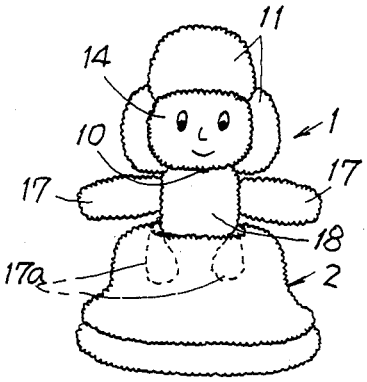
FIG. 7 shows still another preferred embodiment of a doll of the present invention.
Figure 8A:
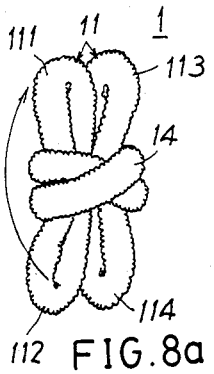
FIGS. 8*a*–8*e* show steps for making the doll as shown in FIG. 7.
Figure 8B:
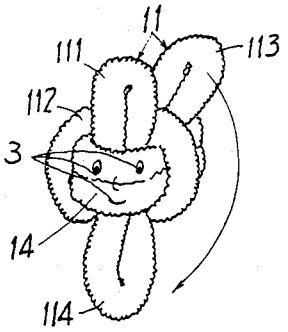
Figure 8C:
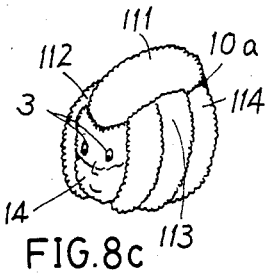
Figure 8D:
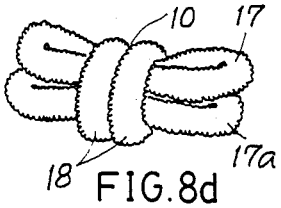
Figure 9A:
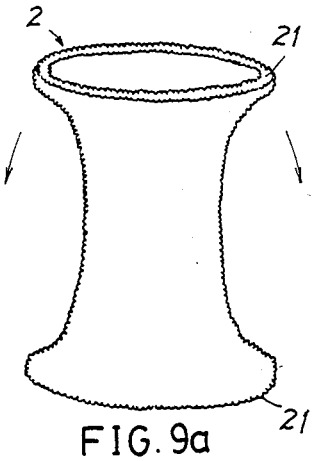
FIGS. 9*a*–9*d* show steps for folding a skirt of a doll as shown in FIG. 8.
Figure 8E:
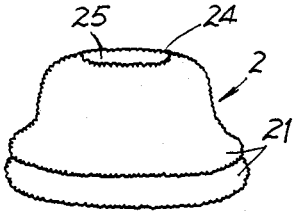
Figure 9B:
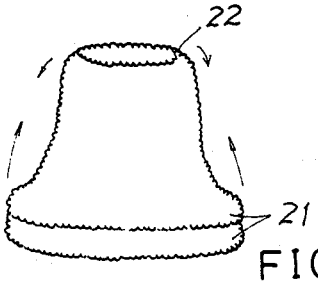
Figure 9C:
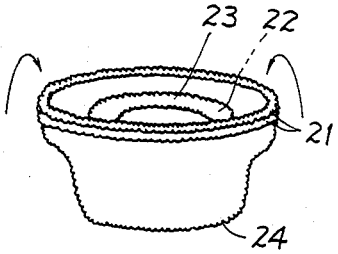
Figure 9D:
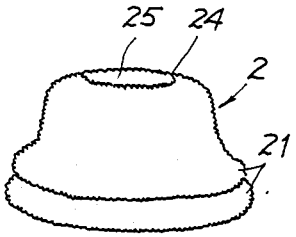

As shown in FIGS. 7, 8, 9, a doll wearing a skirt is shown in which FIGS. 8*a*, 8*b*, 8*c* illustrate the steps forming a doll head, FIG. 8*d* showing a doll body and FIG. 8*e* showing a doll skirt which is further illustrated in FIG. 9.

The head and body of the doll can be assembled by a plurality of stretchable rings 1 as aforementioned, whereas the skirt may be formed by pleating a stretchable cylinder 2 or a cylinder 2 having its two opening ends divergently enlarged as shown in FIG. 9.

In making the doll head as shown in FIGS. 8*a*–8*c*, two vertical rings 11 are first horizontally tied by a double-loop ring 14 which ring 14 serving as a doll face having soft velvet surface, the front lower loop 112 is turned over to be overlain between two upper loops 111, 113 of the two rings 11 as shown in FIGS. 8*a*, 8*b* and the rear upper loop 113 is turned down to be jacketed on the rear lower loop 114. As shown in FIG. 8*c*, all loops 111, 112, 113, 114 besides the face loop of ring 14 can be stitched together such as at numeral 10*a* to form a doll hair. The drawing of the doll hair as shown in FIG. 8*c* is just for illustration purpose. In practical preparation of doll hair, the terry surface of each ring may form a hair like arrangement, without forming the several ugly "boundary lines" defined among the loops 111, 112, 113, 114. Two horizontal rings 17, 17*a* are wound by a central ring 18 forming double loops jacketed on the two rings 17, 17*a* so that upper ring 17 serves as two arms of the doll and the lower ring 17*a* serves as her two legs which may be worn in skirt 2 as shown in FIGS. 7–9.

The skirt 2 as shown in FIG. 9 is originally shaped as a stretchable cylinder 2 formed by knitting process, having two ruffs 21 formed on two opening edges of the cylinder 2. The longitudinal cylinder as shown in FIG. 9*a* is folded one half of the original height as shown in FIG. 9*b*. The upper annular extension 22 is wound downwardly, while the lower two ruffs 21 are wound upwardly as shown in the arrow directions to be an inversed skirt as shown in FIG. 9*c* which is then turned the upside down to be a skirt for wearing the doll legs 17*a* as shown in FIGS. 8*e* and 7.

Besides the examples as above-mentioned, the present invention can be modified and manipulated to be other configurations, structures, shapes or fashions for a toy, a doll, an animal, an ornamental or decorative article.

The present invention is superior to a conventional assembled toy or decorative article with the following advantages:

1. The basic unit for assembling a gigantic toy or an ornamental article is merely a ring, a torus or a cylinder so that its manufacturing cost is very low.

2. The rings or cylinders are made of stretchable knitting materials so that the assembled article may mimic a doll or an animal very vividly and lively.

3. Any style or shape of the assembled article can be finished just by optionally assembling the plural basic rings or cylinders, thereby enhancing a player's interest.

I claim:

1. An assembled article comprising: a plurality of rings which are tied, wound, bound, bonded or assembled with one another for assembling an article of a doll, an animal, an ornamental or decorative article having three dimensional configuration, the improvement which comprises:

said rings being stretchable knitted rings each said knitted ring made of knitting material having terry surface reinforced by rubber yarn forming a seamless stretchable ring; said assembled article including a head portion having at least a first horizontal ring wound around two vertical rings to form two loops of said first horizontal ring for serving as a face of said assembled article, and a body portion formed by winding a central vertical ring on two second horizontal rings to form double loops of said central vertical ring, an upper ring of said second horizontal rings of said body portion having two upper side loops protruding laterally from the central vertical ring serving as two arms of said assembled article and a lower ring of said second horizontal rings of said body portion having two lower side loops protruding laterally from said central vertical ring serving as two legs of said assembled article.

2. An assembled article according to claim 1, wherein said head portion of an assembled article serving as a doll includes two upper loops and two lower loops of two said vertical rings as horizontally wound by said first horizontal ring, said upper and lower loops of two said verticle rings being connected by stitching for forming hair of said doll.

3. An assembled article according to claim 1, wherein an assembled article serving as a doll includes a lower second horizontal ring serving as two legs of the doll, two said legs of said doll being inserted into a cylinder made of stretchable knitting material to serve as a skirt worn by said legs of said doll.

4. An assembled article according to claim 3, wherein said cylinder includes two ruffs formed on two opening edges enlarged on two opposite ends of said cylinder, said cylinder with two said ruffs being folded to form a two-ruff skirt to be worn by said doll.

5. An assembled article according to claim 1, wherein a further horizontal ring is inserted through two said vertical rings of said head portion to have two further side loops protruded laterally from the vertical rings, serving as two ears of an animal.

6. An assembled article according to claim 1, wherein a twisting ring is twistingly wound around a plurality of side loops protruding from said rings forming said assembled article to mimic an animal more precisely.

* * * * *